US005842402A

United States Patent [19]

Collier

[11] Patent Number: 5,842,402

[45] Date of Patent: Dec. 1, 1998

[54] SAFETY DEVICE WITH CUTTING EDGE USED WHEN CUTTING FABRIC AND LIKE PRODUCTS

[76] Inventor: Courtney E. Collier, 6584 S. Clermont Ct., Littleton, Colo. 80121-3215

[21] Appl. No.: 779,618

[22] Filed: Jan. 7, 1997

[51] Int. Cl.[6] ..... B26D 5/00

[52] U.S. Cl. ..... 83/745; 83/522.11; 33/484; 33/493

[58] Field of Search ..... 83/745, 522.11; 33/485, 492, 484, 486–491, 493, 494; D10/71

[56] References Cited

U.S. PATENT DOCUMENTS

| | | | |
|---|---|---|---|
| 287,480 | 10/1883 | Smith | 33/483 |
| D. 360,149 | 7/1995 | McCubbin | D10/71 |
| D. 364,177 | 11/1995 | Lewis | D10/71 X |
| 781,117 | 1/1905 | Willits | 33/492 |
| 963,001 | 6/1910 | Dibrell | 33/485 |
| 2,634,504 | 4/1953 | Jennings, Jr. | 33/491 |
| 3,406,456 | 10/1968 | Schleich | 33/492 |
| 3,678,586 | 7/1972 | Weber | 33/527 |
| 3,830,130 | 8/1974 | Moore | 83/745 |
| 4,024,831 | 5/1977 | Sperling | 33/493 |
| 5,471,755 | 12/1995 | Haskell | 33/485 |

*Primary Examiner*—M. Rachuba
*Attorney, Agent, or Firm*—Edwin H. Crabtree; Ramon L. Pizarro; Donald W. Margolis

[57] ABSTRACT

A safety device with a cutting edge used with a cutting tool when cutting fabric and other similar items. The safety device designed to protect a first hand of a user of the device when a second hand is using the cutting tool. The safety device includes a base with an upwardly extending vertical protective guard. The guard is sufficient in height to protect the first hand of the user should the cutting tool accidently ride up and over the top of the cutting edge. The cutting edge includes a ruler for measuring the fabric to be cut. On one side of the base is the cutting edge with ruler for guiding the cutting tool when cutting fabric. On an opposite side of the base is a hand rest for receiving the first hand of the user. The hand rest is sufficient in width to receive the first hand on top thereof and for allowing the first hand to apply pressure on top of the fabric as it is cut. A top portion of the guard includes a protective lip to prevent the cutting tool from accidently engaging the top of the first hand during the cutting process. Also the protective lip can be used for lifting and moving the safety device.

4 Claims, 1 Drawing Sheet

SAFETY DEVICE WITH CUTTING EDGE USED WHEN CUTTING FABRIC AND LIKE PRODUCTS

BACKGROUND OF THE INVENTION (a) Field of the Invention

This invention relates to a safety device used when cutting fabric and like products and more particularly, but not by way of limitation, to a safety device with cutting edge designed to protect a user's hand when using the cutting edge to cut fabric.

(b) Discussion of Prior Art

Fabric is generally cut in layers (from 2 to 16 layers) with a rotary cutter. The rotary cutter is very sharp and can be dangerous if used improperly. Heretofore, a person cutting the fabric used a ruler of different lengths with the ruler laid on the fabric. For a right handed person, the ruler and fabric are held in place by the left hand while the right hand cuts the fabric using the rotary cutter. Measurements on the ruler are used for measuring the length of material cut as the rotary cutter is glided along a cutting edge of the ruler. The left hand, which is holding the ruler during the cutting operation, is placed in an unprotected position should the rotary cutter slip over the top of the ruler or jump over the cutting edge. When this happens, the left hand may be seriously injured. Naturally, the more layers of fabric being cut, the greater the amount of force/pressure being applied to the rotary cutter and the greater the potential for injury to the left hand holding the ruler in place. For a left handed person the right hand is placed in jeopardy when cutting fabric.

Recently a new product has been introduced in the market called "Fingerguard Safety Ruler" made by Lisa Kidd, Ocean Pack, Me. This device is similar to the subject invention and includes a ruler with cutting edge and a small vertical wall next to the cutting edge. The wall is approximately 1 inch in height and while an improvement over using a standard ruler, the wall height gives only limited protection to an unguarded hand during the cutting operation.

In U.S. Pat. No. 4,924,594 to Fernandes, U.S. Pat. No. 5,138,759 to Gruetzmacher, U.S. Pat. No. 4,989,335 to Day and U.S. Pat. No. 1,835,364 to Woerner different types of cutting guides and cutting tools are described. None of these prior art patents disclose or teach the unique features, objects, advantages and combination of structure of the subject safety device with cutting edge described herein.

SUMMARY OF THE INVENTION

In view of the foregoing, it is a primary object of the subject invention to protect a first hand of a user of the device when a second hand is using a cutting tool such as a rotary cutter, knife or similar cutting tool when cutting fabric and like products. The safety tool includes a vertical protective guard sufficient in height to prevent an unguarded hand from being injured by cutting into the side of a finger or thumb.

Another object of the invention is the safety device can be used easily by children and adults alike when quilting and other types of activities and hobbies. The vertical protective guard and a protective lip provide complete protection of a hand applying force on top of the fabric and like applications when the other hand is holding a cutting tool. The protective lip allows for lifting and adjusting the safety device during the cutting operation. The protective lip also protects the top of the hand should the cutting tool accidently ride up and over the vertical protective wall or the tool is dropped during the process.

Still another object of the safety device is a hand rest for the hand holding the device on top of the fabric which is sufficient in width for allowing the entire hand to rest on top of the hand rest and for applying pressure/force on top of layers of fabric when cutting different types and lengths of fabric.

Yet another object of the invention is the safety tool may be made in various lengths and widths and of different types of light weight metals, plastics, acrylics, etc. The cutting edge of the safety tool may be used by not only hand crafters but by builders, handymen, artists and people in a variety of professions requiring a safety cutting edge during a cutting operation.

The safety device includes a base with an upwardly extending vertical protective guard. The guard is sufficient in height to protect the first hand of the user should the cutting tool accidently ride up and over the cutting edge. On one side of the base is the cutting edge for guiding the cutting tool when cutting fabric. On an opposite side of the base is a hand rest for receiving the first hand of the user. The hand rest is sufficient in width to receive the first hand on top thereof and for allowing the first hand to apply pressure on top of the fabric as it is cut. A top portion of the guard includes a protective lip to prevent the cutting tool from accidently engaging the top of the first hand during the cutting process.

These and other objects of the present invention will become apparent to those familiar with cutting edges or straight edges used for cutting fabric and like products from the following detailed description, showing novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figure 1:
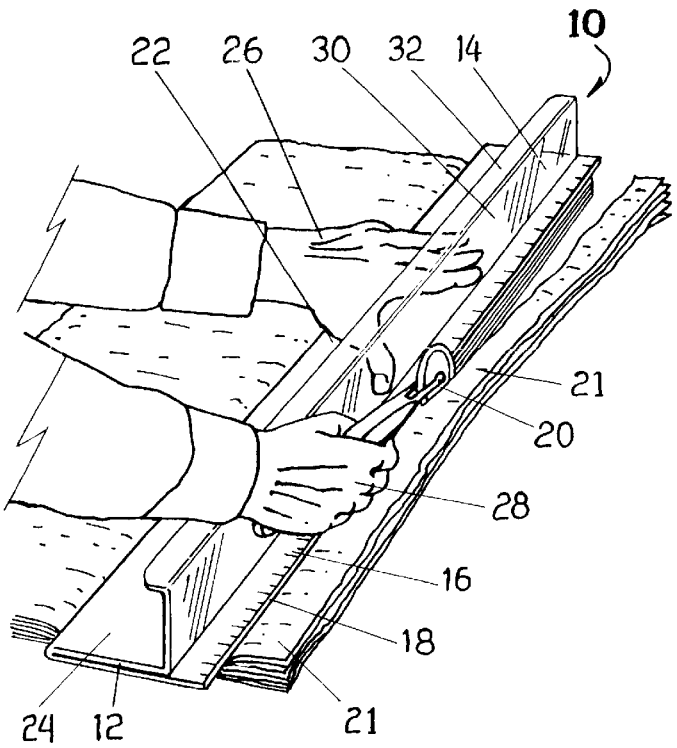
FIG. 1 is a perspective view of the subject safety device with cutting edge. The safety device is shown being held in place by the left hand of a user while the right hand holds a rotary cutter for cutting layers of fabric.

In FIG. 1, a perspective view of the subject safety device is illustrated having general reference numeral 10. The safety device 10 broadly includes a horizonal base 12 with an upwardly extending vertical protective guard 14. On one side 16 of the base 12 is a straight edge or cutting edge 18 which acts as a guide for guiding a rotary cutting tool 20 along the length of the edge 18 and cutting layers of fabric 21. While a rotary cutting tool 20 is shown in this drawing it should be kept in mind that a knife or other types of cutting tools can be used equally well with the subject invention. Also while the fabric 21 is shown, the safety device 10 can be used equally well in other industries for cutting a variety of different types of products.

On an opposite side 22 of the base 12 is a hand rest 24 for receiving a first hand 26 of the user of the device 10. The vertical protective guard 14 divides the base 12 into side 16 and opposite side 22. A second hand 28 is shown holding the rotary cutting tool 20 and cutting layers of fabric 30 along the length of the straight edge 18. The first hand 26 is shown as a left hand while the second hand 28 is shown as a right hand. Obviously for a left handed person, the second hand 28 could be shown as a left hand holding the tool 20 and the right hand used for holding down the safety device 10.

In this drawing, a top portion 30 of the vertical protective guard 14 is shown with a horizontal protective lip 32 formed therein and extending over a portion of the hand rest 24 on the opposite side 22. The width of the lip 32 is at least 1 inch or greater for added protection to the first hand 26. Should the tool 20 accidently climb the protective guard 14 or the tool 20 accidently dropped, the protective lip 32 is designed to protect the top of the first hand 26 from the sharp cutting edge of the rotary cutting tool 20.

Figure 2:
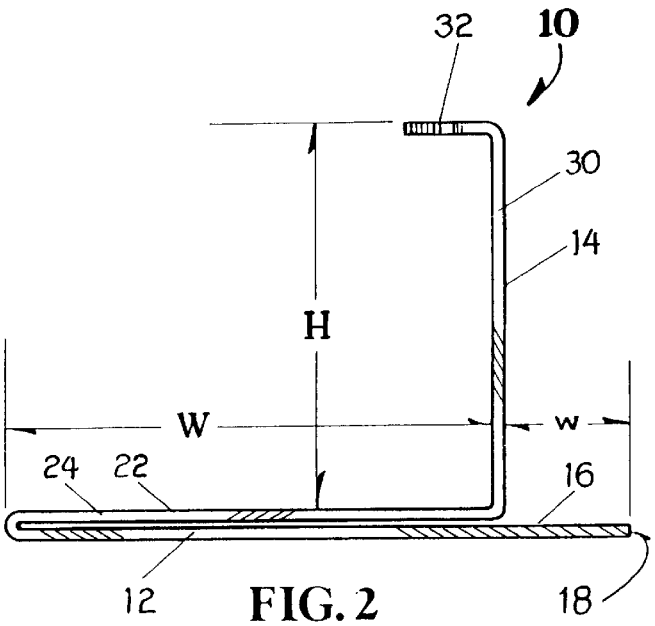
FIG. 2 is a side view of the safety device illustrating ranges of width and height of the device's structural members for providing complete protection of the user's hand.

In FIG. 2, a side view of the safety device 10 is illustrated wherein the vertical protective wall 14 has a height of "H". The height "H" may be in a range of a minimum height of 2 to 3 inches up to 5 inches or greater. The height "H" must be sufficient to protect the side of the hand 26 when the hand is laying flat on the hand rest 24 or raised when the hand is applying force against the top of the safety device 10 and applying leverage on top of the layers of fabric 21.

A width "W" of the hand rest 24 is in a range of 5 inches to 8 inches or greater to provide sufficient room for the hand 26 to rest thereon. A width "w" of the one side 16 is in a range of 1 inch to provide adequate room for the hand 28 as it guides the cutting tool 18 along the length of the cutting edge 18.

The safety device 10 may be made of a light weight metal such as aluminum. Also the device 10 may be made of plastic, acrylic and similar materials. In the drawings, the device 10 is shown made of a transparent plastic material in a range of ⅛ inch thick. The protective lip 32 is integrally formed at a 90 degree angle from the top portion 30 of the vertical protective guard 14. The base 12 is formed at a 90 degree angle from a bottom portion 34 of the vertical protective guard 14. The base 12 may be formed in a variety of ways and in this example is extended across the width "W" of the hand rest 24 and then bent 180 degrees and extended past the vertical protective guard 14 with an end of the base 12 forming the cutting edge 18.

Figure 3:
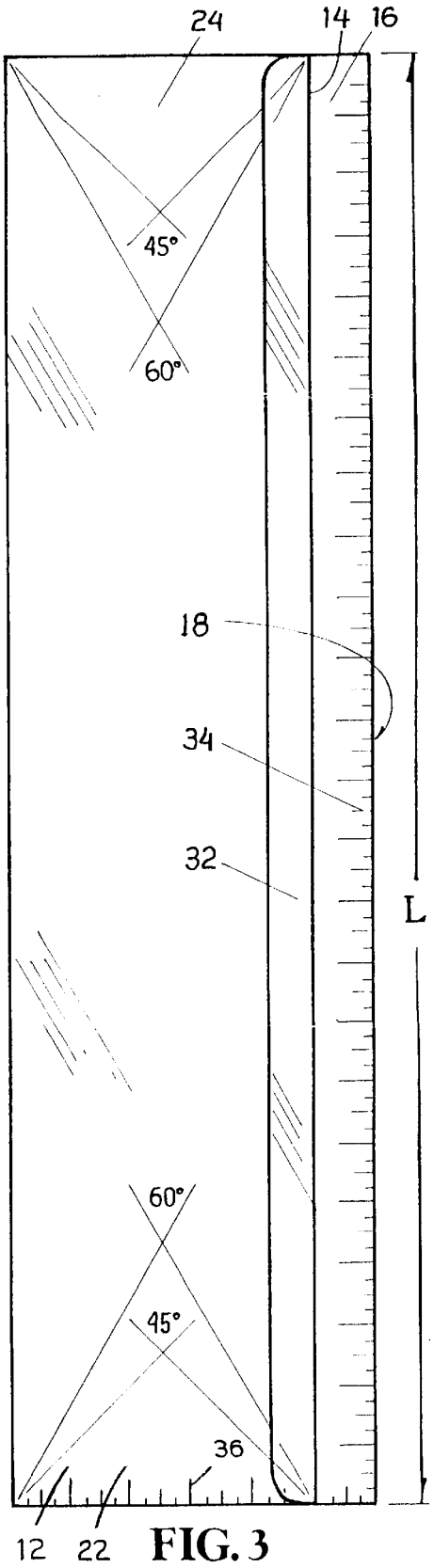
FIG. 3 is a top view of the safety device illustrating the range of length of the device and scales of measurement along the width and length of the subject invention.

In FIG. 3, a top view of the safety device 10 is shown illustrating the range of length "L" of the device. The length "L" may be 12 inches, 18 inches, 24 inches or greater. The one side 16 on the base 12 includes scales 34 of measurement for measuring fabric as it is cut. Also scales 36 along the width of the base 12 may be provide for different measurements. The scales 34 and 36 along with 45 degree and 60 degree angle lines may be provided by embossing or printing the measurement grid along the sides of the base 12 and the cutting edge 18 to aid the user of the subject invention.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. A one-piece safety device used with a cutting tool when cutting fabric, the safety device designed to protect a first hand of a user holding the safety device in place on top of the fabric when a second hand is using the cutting tool, the one-piece safety device comprising:

a base having a cutting edge adapted for guiding the cutting tool when cutting fabric, said cutting edge having a measuring scale along its length for measuring the length of fabric to be cut, said base having a measuring scale along one side thereof for measuring fabric; and an upwardly extending vertical protective guard mounted on said base, said guard having a height in a range of 2 to 6 inches and greater, said guard having a length the same as the length of said cutting edge and in a range of 12 to 36 inches, said guard dividing said base into a horizontal first side and a horizontal second side, said cutting edge on said base disposed on the second side of said base, said second side having a width sufficient for receiving a portion of the second hand thereabove as the cutting tool is guided along a length of said cutting edge;

a protective lip attached to a top portion of said guard, said lip extending over a portion of the first side of said base;

whereby the first hand of the user is adapted for resting on the first side of said base and should the cutting tool accidently ride up and over the top of said cutting edge and onto said second side, the first hand is protected from the cutting tool by said vertical protective guard.

2. The device as described in claim 1 wherein said protective lip is a horizontal protective lip extending parallel to and over a portion of the first side of said base, said protective lip having a width in a range of 1 to 2 inches and greater.

3. The device as described in claim 1 wherein the first side of said base has a width in a range of 5 to 8 inches for receiving the first hand thereon as a hand rest for holding the safety device in place and applying pressure on top of the fabric to be cut.

4. The device as described in claim 1 wherein the second side of said base has a width in a range of 1 to 2 inches for receiving a portion of the second hand thereabove as the cutting tool is guided along a length of said cutting edge.

* * * * *